United States Patent [19]

Shaffer et al.

[11] 4,097,221

[45] Jun. 27, 1978

[54] PHOTOFLASH LAMP WITH COMBUSTIBLE FILAMENT

[75] Inventors: John W. Shaffer; Emery G. Audesse, both of Williamsport, Pa.

[73] Assignee: GTE Sylvania Incorporated, Stamford, Conn.

[21] Appl. No.: 526,642

[22] Filed: Nov. 25, 1974

[51] Int. Cl.[2] ..... F21K 5/02

[52] U.S. Cl. ..... 431/95 R

[58] Field of Search ..... 431/93–95

[56] References Cited

U.S. PATENT DOCUMENTS 2,571,799 10/1951 Van Uden et al. ..... 431/95

3,123,993 3/1964 Cressman et al. ..... 431/95

FOREIGN PATENT DOCUMENTS 588,183 12/1959 Canada ..... 431/93

*Primary Examiner*—Carroll B. Dority, Jr.

*Attorney, Agent, or Firm*—Edward J. Coleman

[57] ABSTRACT

A photoflash lamp having an ignition filament composed of a combustible metal, such as zirconium, hafnium, or titanium, to assure reliable lamp operation from low current power sources. In miniature high pressure lamps, the combustible filament may be employed as the sole ignition source, without the need for primer beads.

8 Claims, 4 Drawing Figures

PHOTOFLASH LAMP WITH COMBUSTIBLE FILAMENT

BACKGROUND OF THE INVENTION

This invention relates in general to the manufacture of photoflash lamps, and, more particularly, to flashlamps of the type filled with combustible material ignited in a combustion-supporting atmosphere by an electrically conductive filament.

A typical photoflash lamp comprises an hermetically sealed glass envelope containing a quantity of combustible fill material, such as shredded zirconium or hafnium foil, and a combustion-supporting gas, such as oxygen, at a pressure above one atmosphere. In electrically ignitable photoflash lamps, the ignition means typically comprises a pair of lead-in wires sealed through and extending inside one end of the tubular glass envelope. A tungsten filament is mounted across the inner ends of the two lead-in wires with the ends of the wires at their junctions with the filament being coated with a primer material, such as a powdered zirconium mixture.

Operation of the photoflash lamp is initiated by an electrical current pulse supplied across the external ends of the two lead-in wires. The current flow through the ignition filament causes it to be heated to an elevated temperature. This ohmic heating of the tungsten filament wire conductively heats the beads of primer material contacting the filament wire. When the beads of primer material reach their ignition temperature, they deflagrate and expel burning metal powder throughout the lamp volume. Ths, in turn, ignites the shredded metallic combustible material, which upon burning generates the actinic output of the lamp.

In a typical application, a plurality of such lamps are contained in a multisided flash unit, known as a flashcube, which is adapted for direct mounting on a camera. When the flash unit is in the firing position, segments of the lead-in wires disposed outside the lamp envelope are securely engaged with electrical contacts in the camera socket, which in turn are connected by wires and a shutter-actuated switch to the camera power source, usually a pair of dry cell batteries. When a photographer actuates the shutter release mechanism to "snap" a picture, he also, by the same operation, closes the electrical circuit from the batteries to the ignition system in the lamp to thereby flash the lamp. The timing of the ignition of the combustible fill material in the lamp is synchronized with the exposure of the film by the actuation of the shutter release so that efficient utilization of the light from the flashlamp may be obtained.

A not infrequent problem that has been faced by the average amateur photographer when using a battery operated flash system, however, has been failure of the lamp to fire due to weak batteries and/or dirt and corrosion on one or more of the electrical contacts in the system. One approach toward overcoming this problem is to increase the electrical sensitivity of the lamp, such as by using a much finer tungsten wire for the ignition filament. A lower current flow will then suffice to heat the smaller diameter filament to the required temperatures. Such a solution, however, does not appear practical for a number of reasons. Significant production problems and losses can occur due to breakage and mounting difficulties with such fine wire on modern, high speed, automated equipment. Movement of the shredded metallic combustible fill materials within the lamp, either during insertion or during lamp shipment and handling, can cause filament breakage, resulting in inoperative lamps. Finally, filament burnout may occur before sufficient heat has been transferred to the beads of ignition paste to assure deflagration.

Another means of increasing lamp sensitivity involves the use of a tungsten alloy of higher electrical resistivity then pure tungsten. For example, U.S. Pat. No. 3,123,993 describes the use of a tungsten-rhenium filament. This technique gives limited gains and has been widely used commercially. It is against such filaments that the ignition means of the present invention is compared.

SUMMARY OF THE INVENTION

In view of the foregoing, it is an object of this invention to provide an improved photoflash lamp with a more reliable electrical ignition means.

A particular object of the invention is to provide an improved ignition means for electrically fired photoflash lamps which gives greatly enhanced flash reliability when used with weak batteries or otherwise marginal flash current conditions.

These and other objects, advantages and features are attained, in accordance with the principles of this invention, by using a combustible filament comprising a material selected from the group consisting of zirconium, hafnium, titanium, uranium, thorium, and the rare earth metals, and alloys comprised principally of one or more materials of this group. According to one embodiment, in flash lamps wherein the density of the combustible fill material within the envelope is greater than about 0.25 millimoles per milliliter of internal envelope volume, the ignition means is free of primer material and the combustible filament provides the sole means from which the combustible fill material is initially ignited.

BRIEF DESCRIPTION OF THE DRAWINGS

This invention will be more fully desribed hereinafter in conjunction with the accompanying drawings in which.

DESCRIPTION OF PREFERRED EMBODIMENT

Figure 1:
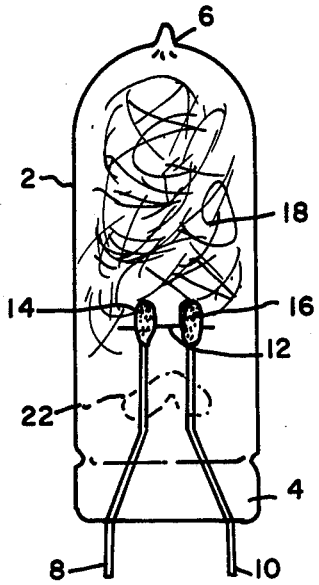
FIG. 1 is an elevational view of an electrically ignitible photoflash lamp provided wth a combustible filament in accordance with the invention and having primer beads at the inner ends of the lead-in wires.
Figure 2:
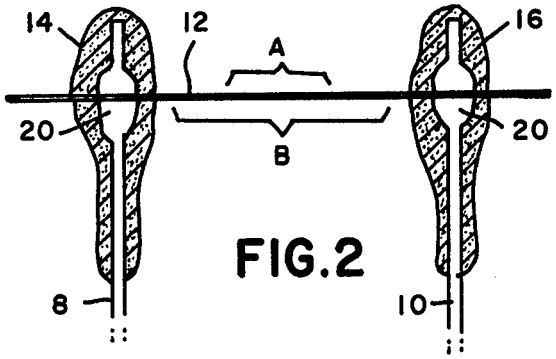
FIG. 2 is a vertical sectional view on an enlarged scale of the ignition means of the lamp of FIG. 1, including the lead-in wires, ignition filament, and beads primer material.

Referring to FIG. 1, the electrically ignitable photoflash lamp illustrated therein comprises an hermetically sealed light-transmitting lamp envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press. A filament 12 spans the inner ends of the lead-in wires, andbeads of primer material 14 and 16 are located on the inner ends of the lead-in wires 8 an 10, respectively, at their junctions with the filament. Typically, the lamp envelope 2 has an internal diameter of less than one-half inch, and an internal volume of less than 1 cc. A quantity of filamentary combustible fill material 18, such as shredded zirconium or hafnium foil, is disposed within the lamp envelope. The envelope 2 is also provided with a filling of combustion supporting gas, such as oxygen for example, at a pressure of several atmospheres. In many applications, the combustible material and the combustion supporting gas are substantially in stoichiometric balance Referring to FIG. 2, which shows the lead-in wires 8 and 10, ignition filament 12, and beads of primer material 14 and 16 in greatly enlarged section, the enlarged aras 20 on the lead-in wires represent mechanical swages which anchor the filament 12. Alternatively, filament 12 may be held to the lead-in wires by other means such as, for example, spot welds. When an electrical current is passed through this structure, the filament does not attain a uniform temperature along its length. Rather, the central section A of the filament is hottest, with a longer section B attaining a somewhat lower mean temperature. Those filament segments between section B and the lead-in wires 8 and 10 would remain appreciably cooler due to heat losses to the lead-in wires. Accordingly, only a fraction of the electrical energy input is effective in heating and igniting the beads of primer material 14 and 16.

In accordance with the present invention, we have discovered that the use of certain combustible metals, such as zirconium, hafnium, or titanium, for the filament wire in electrically ignitable photoflash lamps affords an unexpectedly high reliability at low electrical current levels. For filaments of essentially equal cross sectional area, about twice the amount of current in amperes is required for tungsten-rhenium alloy as is needed for zirconium or hafnium to attain a given lamp reliability level. It has also been found that miniature high pressure lamps without beads of primer material function quite reliably with combustible filaments in accordance with the invention, whereas, from about 1 to 15 percent lamp failures generally occur with similar lamps having tungsten alloy filaments.

Figure 3:
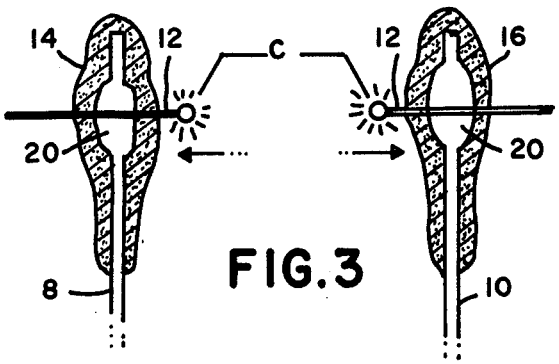
FIG. 3 is a view similar to FIG. 2 with portions of the filament burned back to illustrate the behavior of a filament according to the present invention during ignition.

FIG. 3 illustrates the observed behavior of combustible filaments in accordance with the invention and explains, at least on part, how such a dramatic increase in sensitivity is achieved. The central hottest section of, for example, the zirconium filament ignites at an early time after current switch-on time. The combustible filament then burns, giving rise to two primary molten burning globules C, which travel back along the filament where they collide with and ignite the beads of primer material 14 and 16. The first ignition within the lamp of FIG. 1, therefore, is the filament itself rather than the beads of primer material as is customarily the case. The electrical input energy needed is only that amount necessary to heat the central portion of the combustible metal filament to its ignition temperature in the oxygen atmosphere of the lamp.

Figure 4:
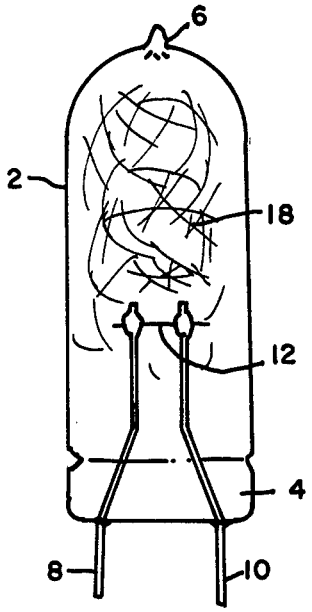
FIG. 4 illustrates another embodiment of a lamp according to the invention in which the ignition structure is free of primer material.

In miniature flashlamps wherein the density of the combustible fill material 18 within the envelope is greater than about 0.25 millimoles per milliliter of internal envelope volume, the proximity of the shredded metallic combustible to the burning electrical filament of the present invention is sufficient to assure lamp ignition without the need for primer material. That is, the sole means from which the combustible fill material 18 is initially ignited is the combustible filament 12. Such a lamp embodiment is illustrated in FIG. 4. This eliminates the need for preparation and use of the relatively hazardous primer material, or ignition paste, in the lamp manufacturing process. It also greatly simplifies the construction of miniature lamps having an internal diameter of 5 millimeters or less. As lamp internal diameter decreases, it becomes progressively more difficult to reliably apply the beads of igntion paste without smearing it on the inner glass wall of the lamp. Such unintentional deposits would affect light output, timing and containment.

The improved construction described herein functions with equal reliability at about half the electrical current input required for a lamp having a tungsten-rhenium alloy filament of about equal cross-section. In order to attain comparable electrical properties, the filament span between the lead-in wires should be shortened somewhat in comparison with the filament length used with tungsten-rhenium wire. This is a result of the higher electrical resistivities of zirconium, hafnium, and titanium as compared to tungsten-rhenium alloy.

Thorium, uranium, and the rare earth metals may be used as alternatives to the preferred metals, zirconium, hafnium, and titanium. Alloys of these suggested metals with one another may be used in place of the pure metals; also, alloys comprised principally of one or more metals of the above group may be used. Further, the sensitivity advantages realized by using the combustible filament are applicable to large lamps of earlier design, as well as to the highly miniaturized types. Only the concept of making lamps without primer beads, or ignition paste, is restricted to such small lamps, or to larger lamps having high densities of shredded combustible.

In one typical embodiment of the invention, a zirconium filament was provided in an M-3 flashlamp. The envelope was a type T 6 ½ bulb of soda-lime glass and had a nominal outside diameter of about 0.822 inch, an overall outside length of 1.732 inch, and an internal volume of 7.0 cc. The exterior surface of the glass envelope had a protective lacquer coating of cellulose acetate. The lamp contained a combustible fill comprising about 42 milligrams of shredded zirconium foil and oxygen at a fill pressure of about 1.58 atmospheres. The lead-in wires were of copper coated dumet, having a diameter of approximately 10 mils. The filament comprises a zirconium shred having a cross-section of about 0.90 × 1.2 mils and was attached to the lead-in wires by spot welding. The ends of the lead-in wires at their junctions with the filament were spaced apart by about 0.025 inch and covered with beads of a primer material composed of a powdered zirconium, potassium perchlorate, and a cellulose nitrate binder. Ten-lamp groups were flashed at varying flash currents to determine the minimum current required for reliable operation. These test lamps, having a zirconium filament of 1.08 square mil cross-section, showed reliable functioning at about 0.48 amperes. In comparison, similar control lamps having tungsten-3.26rhenium filaments of even finer cross section (0.785 square mil) showed the required flash current to be 0.90 amperes.

In another embodiment of the invention, a hafnium filament was provided in a flashlamp similar to the type shown in FIG. 4 but having a shaped glass head 22, as indicated in dashed lines, to support the lead-in wires in a spaced side-by-side relationship. The tubular envelope 2 was formed of a borosilicate hard glass and had a noiminal outside diameter of about 0.259 inch, an overall outside length of 0.980 inch, and an internal volume of 0.32 cc. The exterior surface of the glass envelope has a protective lacquer coating of cellulose acetate. The lamp contained a combustible fill comprising about 29 milligrams of shredded hafnium foil and oxygen at a fill pressure of about 13 atmospheres. The lead-in wires 8 and 10 were of an iron-nickel-cobalt alloy, called Rodar, having a diameter of approximately 14 mils. The filament 12 comprised a hafnium shred having a cross-section of about 0.87 × 1.2 mils and was attached to the lead-in wires by spot welding. Primer beads were not employed. Test groups of such lamps, both with and without the primer beads 14 and 16, were flashed from a 3 volt DC source comprising two D-cell batteries. For comparison, control groups of similar lamps having tungsten-3.26% rhenium filaments with a cross-section of 0.785 square mil, both with and without primer beads, were tested using the same power source. 100 percent of both the hafnium-filament and tungsten-rhenium-filament lamps with primer beads were successfully flashed. Among the primerless lamps, however, 100 percent of the hafnium-filament lamps flashed, whereas less than 85 percent of the tungsten-rhenium-filament lamps were successful in flashing.

In summary, the present invention provides an ignition filament for electrically ignitable photoflash lamps which effectively provides chemical amplification of the input energy so as to provide high device functioning reliability at lower levels of electrical input energy than were permissible heretofore. Whereas early filament burnout is detrimental to reliability in conventional flashlamps, it is herein used as a means of achieving greatly superior reliability at low current levels.

Although the invention has been described with respect to specific embodiments it will be appreciated that modifications and changes may be made by those skilled in the art without departing from the true spirit and scope of the invention.

What we claim is:

1. A photoflash lamp comprising:

an hermetically sealed, light-transmitting envelope;

a quantity of combustible fill material located in said envelope;

a combustion-supporting gas in said envelope; and ignition means disposed in said envelope in operative relationship with respect to said combustible fill material, said ignition means including a pair of lead-in wires extending into said envelope, and a combustible filament having a substantially constant cross-section of the order of one square mil attached to and extending between said lead-in wires within said envelope, the sale material of said filament being selected from the group consisting of zirconium, hafnium, titanium, uranium, thorium, and the rare earth metals, and alloys comprised principally of one or more materials of said group.

2. The lamp of claim 1 wherein said combustion-supporting gas is oxygen.

3. The lamp of claim 2 wherein said combustible fill material is filamentary.

4. The lamp of claim 3 wherein the material comprising said filament is zirconium, hafnium or titanium.

5. The lamp of claim 1 wherein said pair of lead-in wires are sealed through and extend inside one end of said envelope, and said filament is attached to said lead-in wires near the inner ends thereof.

6. The lamp of claim 5 wherein said ignition means further includes beads of primer located on the inner ends of said lead-in wires at the junction between the lead-in wires and the filament.

7. The lamp of claim 1 wherein the density of said combustible fill material within said envelpe is greater than about 0.25 millimoles per milliliter of internal envelope volume, and the sole means from which said combustible fill material is initially ignited is said filament.

8. The lamp of claim 7 wherein said combustible fill material is filamentary.

* * * * *

UNITED STATES PATENT AND TRADEMARK OFFICE

CERTIFICATE OF CORRECTION

PATENT NO. : 4,097,221

DATED : JUNE 27, 1978

INVENTOR(S) : JOHN W. SHAFFER, EMERY G. AUDESSE

It is certified that error appears in the above-identified patent and that said Letters Patent are hereby corrected as shown below:

Column 6, Line 13 delete "sale" and insert -- sole --.

Signed and Sealed this

Seventh Day of November 1978

[SEAL]

*Attest:*

RUTH C. MASON
*Attesting Officer*

DONALD W. BANNER
*Commissioner of Patents and Trademarks*